US010741125B2

(12) United States Patent
Yang et al.

(10) Patent No.: US 10,741,125 B2
(45) Date of Patent: Aug. 11, 2020

(54) PIXEL UNIT AND DRIVING METHOD THEREOF, DISPLAY PANEL AND DRIVING METHOD THEREOF, AND DISPLAY APPARATUS

(71) Applicant: BOE Technology Group Co., Ltd., Beijing (CN)

(72) Inventors: Shengji Yang, Beijing (CN); Xue Dong, Beijing (CN); Jing Lv, Beijing (CN); Xiaochuan Chen, Beijing (CN); Minghua Xuan, Beijing (CN); Can Zhang, Beijing (CN); Ming Yang, Beijing (CN); Yan Li, Beijing (CN); Xiaoling Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 84 days.

(21) Appl. No.: 16/070,513

(22) PCT Filed: Dec. 15, 2017

(86) PCT No.: PCT/CN2017/116576
§ 371 (c)(1),
(2) Date: Jul. 16, 2018

(87) PCT Pub. No.: WO2018/223656
PCT Pub. Date: Dec. 13, 2018

(65) Prior Publication Data

US 2019/0371243 A1 Dec. 5, 2019

(30) Foreign Application Priority Data

Jun. 5, 2017 (CN) ..... 2017 1 0413896

(51) Int. Cl.
*G09G 3/30* (2006.01)
*G09G 3/3241* (2016.01)
*G09G 3/36* (2006.01)

(52) U.S. Cl.
CPC ..... *G09G 3/3241* (2013.01); *G09G 3/3655* (2013.01); *G09G 3/3688* (2013.01); *G09G 2300/0465* (2013.01)

(58) Field of Classification Search
CPC ... G09G 2300/0809; G09G 2300/0852; G09G 2300/0861; G09G 2310/0251;
(Continued)

(56) References Cited

U.S. PATENT DOCUMENTS

2006/0114193 A1 6/2006 Kwak et al.
2014/0168179 A1 6/2014 Chung et al.
(Continued)

FOREIGN PATENT DOCUMENTS

CN 103871356 A 6/2014
CN 104575387 A 4/2015
(Continued)

OTHER PUBLICATIONS

International Search Report (ISR) and Written Opinion (WO) issued in International Application No. PCT/CN2017/116576 dated Mar. 21, 2018 (with English translation of ISR and partial English translation of WO).

*Primary Examiner* — Insa Sadio
(74) *Attorney, Agent, or Firm* — McDermott Will & Emery LLP

(57) ABSTRACT

Embodiments of the present disclosure provide a pixel unit and a driving method thereof, a display panel and a driving method thereof, and a display apparatus. The pixel unit comprises a driving sub-circuit, a first switching sub-circuit, a second switching sub-circuit, and a light-emitting element.
(Continued)

The driving sub-circuit has a first terminal electrically coupled to a first power supply terminal, and a second terminal electrically coupled to a first terminal of the light-emitting element. The first switching sub-circuit has an inputting terminal electrically coupled to a data line, an outputting terminal electrically coupled to an inputting terminal of the second switching sub-circuit, and a controlling terminal electrically coupled to a scanning line. The second switching sub-circuit has an outputting terminal electrically coupled to an inputting terminal of the driving sub-circuit.

17 Claims, 5 Drawing Sheets

(58) Field of Classification Search
CPC ... G09G 2310/0262; G09G 2320/0214; G09G 3/003; G09G 3/3241; G09G 3/325; H04N 13/30
See application file for complete search history.

(56) References Cited

U.S. PATENT DOCUMENTS

| | | | | |
|---|---|---|---|---|
| 2014/0313232 | A1* | 10/2014 | Han | G09G 3/3233 345/690 |
| 2015/0161940 | A1* | 6/2015 | Woo | G09G 3/003 345/58 |
| 2016/0307500 | A1 | 10/2016 | Han | |
| 2017/0294163 | A1 | 10/2017 | Wu et al. | |

FOREIGN PATENT DOCUMENTS

| | | | |
|---|---|---|---|
| CN | 104680982 | A | 6/2015 |
| CN | 106652972 | A | 5/2017 |
| CN | 106782268 | A | 5/2017 |
| KR | 10-2006-0056791 | A | 5/2006 |

* cited by examiner

PIXEL UNIT AND DRIVING METHOD THEREOF, DISPLAY PANEL AND DRIVING METHOD THEREOF, AND DISPLAY APPARATUS

CROSS-REFERENCE TO RELATED APPLICATION(S)

This application is a Section 371 National Stage Application of International Application No. PCT/CN2017/116576, which claims the priority of Chinese Patent Application No. 201710413896.X filed on Jun. 5, 2017, the entire disclosures of which are hereby incorporated herein by reference in their entirety as part of this application.

TECHNICAL FIELD

Embodiments of the present disclosure relate to the field of display technology, and in particular, to a pixel unit and a driving method thereof, a display panel and a driving method thereof, and a display apparatus.

BACKGROUND

Generally, the higher a picture quality of a display apparatus (ie, the higher the display resolution) is, the higher a refreshing frequency will be. However, a high refreshing frequency will result in an increasing of power consumption.

SUMMARY

Embodiments of the present disclosure provide a pixel unit and a driving method thereof, a display panel and a driving method thereof, and a display apparatus.

According to an aspect of the present disclosure, there is provided a pixel unit, comprising a driving sub-circuit, a first switching sub-circuit, a second switching sub-circuit, and a light-emitting element, wherein the driving sub-circuit has a first terminal electrically coupled to a first power supply terminal, and a second terminal electrically coupled to a first terminal of the light-emitting element;

wherein the first switching sub-circuit has an inputting terminal electrically coupled to a data line, and an outputting terminal electrically coupled to an inputting terminal of the second switching sub-circuit;

wherein the second switching sub-circuit has an outputting terminal electrically coupled to an inputting terminal of the driving sub-circuit;

wherein the controlling terminal of the first switching sub-circuit is electrically coupled to one of the scanning line and a switch controlling line, and a controlling terminal of the second switching sub-circuit is electrically coupled to the other one of the scanning line and the switch controlling line;

wherein the first switching sub-circuit and the second switching sub-circuit are configured to selectively input a data voltage signal on the data line to a controlling terminal of the driving sub-circuit under a control of a scanning signal on the scanning line and a control of a switch controlling signal on the switch controlling line, so as to control a lighting of the light-emitting element.

For example, the first switching sub-circuit is electrically coupled to the scanning line, and the second switching sub-circuit is electrically coupled to the switch controlling line, and the second switching sub-circuit is configured to be turned on or off under the control of the switch controlling signal on the switch controlling line, so as to control writing of the data voltage signal on the data line into the light-emitting element.

For another example, the first switching sub-circuit comprises a switch transistor, wherein the switch transistor has a first electrode electrically coupled to the data line and a controlling electrode electrically coupled to the scanning line; the second switching sub-circuit comprises a controlling transistor, wherein the controlling transistor has a first electrode electrically coupled to a second electrode of the switch transistor, a second electrode electrically coupled to the driving sub-circuit and a controlling electrode electrically coupled to the switch controlling line.

For another example, the driving sub-circuit comprises: a driving transistor, wherein the driving transistor has a first electrode electrically coupled to the first power supply terminal, a second electrode electrically coupled to a first electrode of the light-emitting element, and a controlling electrode electrically coupled to the outputting terminal of the second switching sub-circuit; and a storage capacitor, wherein the storage capacitor has a first electrode electrically coupled to the first power supply terminal and a second electrode electrically coupled to a controlling electrode of the driving transistor.

For another example, a second terminal of the light-emitting element is coupled to a second power supply terminal.

For another example, the pixel unit is provided on a silicon-based substrate.

According to another aspect of the present disclosure, there is provided a method for driving the pixel unit of above embodiments, comprising:

inputting a valid signal to the scanning line and the switch controlling line respectively, so that both the first switching sub-circuit and the second switching sub-circuit are turned on; and writing the data voltage signal on the data line to the light-emitting element, by the driving sub-circuit, so as to enable the light-emitting element to emit light.

According to yet another aspect of the present disclosure, there is provided a display panel comprising at least one pixel unit of above embodiments.

For example, the display panel is divided into a plurality of display areas arranged in an array, wherein: the second switching sub-circuits of the plurality of pixel units which are disposed in the same display area are electrically coupled to the same switch controlling line.

For another example, the display panel further comprises a line-of-sight capturer and a timing controller, wherein:

the line-of-sight capturer is configured to capture and track a line-of-sight of a human eye, and to obtain a position of the display area which the line-of-sight of the human eye falls into; wherein the position of the display area which the line-of-sight of the human eye falls into is set as the first display area, and the display areas other than the first display area is set as the second display area;

the timing controller is configured, such that the number of times that the pixel units in the first display area are written with the data voltage signal is greater than the number of times the pixel units in the second display area are written with the data voltage signal, during a displaying time of a frame.

For another example, the display panel further comprises a plurality of gate driving units and a plurality of source driving units coupled to the timing controller, wherein: the scanning lines coupled to the pixel units of the same row in the display area are coupled to the same gate driving unit;

and the data lines coupled to the pixel units of the same column in the display area are coupled to the same source driving unit.

For another example, the second switching sub-circuits of the plurality of pixel units which are disposed in the same column in the display panel are electrically coupled to the same switch controlling line.

For another example, a refreshing frequency of the first display area is 2 times than that of the second display area.

According to another aspect of the present disclosure, there is provided a method for driving the display panel of above embodiments, comprising:

inputting a valid signal to the scanning line and the switch controlling line respectively, so that both the first switching sub-circuit and the second switching sub-circuit are turned on; and writing the data voltage signal on the data line to the light-emitting element, by the driving sub-circuit, so as to enable the light-emitting element to emit light.

For example, the display panel further comprises a line-of-sight capturer and a timing controller, and the method further comprises following steps before inputting the valid signal to the scanning line and the switch controlling line:

capturing and tracking a line-of-sight of a human eye by the line-of-sight capturer, and obtaining a position of the display area which the line-of-sight of the human eye falls into, wherein the position of the display area which the line-of-sight of the human eye falls into is set as the first display area, and the display areas other than the first display area is set as the second display area.

For another example, the method further comprises: configuring the timing controller, such that during a displaying time of a frame, the number of times that the scanning lines and the switch controlling lines coupled to the pixel units in the first display area are inputted with the valid signal is greater than the number of times that the scanning lines and the switch controlling lines coupled to the pixel units in the second display area are inputted with the valid signal; and the number of times that the data lines coupled to the pixel units in the first display area are written with the data voltage signal is greater than the number of times that the data lines coupled to the pixel units in the second display area are written with the data voltage signal, under the control of the configured timing controller.

According to another aspect of the present disclosure, there is provided a display device comprising the display panel of above embodiments.

DETAILED DESCRIPTION

To enable a better understanding of the technical solutions of the present disclosure, the present disclosure will be further described in detail below in conjunction with the accompanying drawings and specific implementations.

Transistors employed in the disclosed embodiments may be thin film transistors or field effect transistors or other devices with the same characteristics. Since a source and a drain of a transistor are interchangeable under certain conditions, there is no difference in connection relationship for the source and the drain. In the embodiment of the present disclosure, in order to distinguish between the source and the drain of the transistor, one is referred to as a first electrode, the other is referred to as a second electrode, and the gate is referred to as a controlling electrode. In addition, transistors can be classified into N-type transistors and P-type transistors according to their characteristics. In the following embodiments, the transistors are described as N-type transistors. When the N-type transistor is used, the first electrode is the drain of the N-type transistor, and the second electrode is the source of the N-type transistor. If the gate is at a high level, the source and the drain are turned on, which is opposite for the P-type transistor. It should be understood that the implementation of using a P-type transistor can be easily conceived by those person skilled in the art without paying any creative effort, and thus is also within the scope of the embodiments of the present disclosure.

Since the embodiment is described by taking the N-type transistor as the thin film transistor for an example, a valid signal should be a high-level signal. However, it should be understood that if the thin film transistor is a P-type transistor, the valid signal will be a low-level signal.

A conventional solution is to perform an interlaced scanning within a frame and to charge a pixel that does not need to be charged once every n frames, thereby reducing the power consumption. For example, in the conventional technology, an "AND gate" is coupled to a gate terminal. A state of the AND gate is controlled by pulses, so that states of switches in respective rows can be controlled, achieving the purpose of only scanning a designated row. Since the "AND gate" is required to be fabricated on the array during the manufacture of GOA, the process becomes complicated and is not facilitated in the manufacture of products and improvement of yields.

Figure 1A:
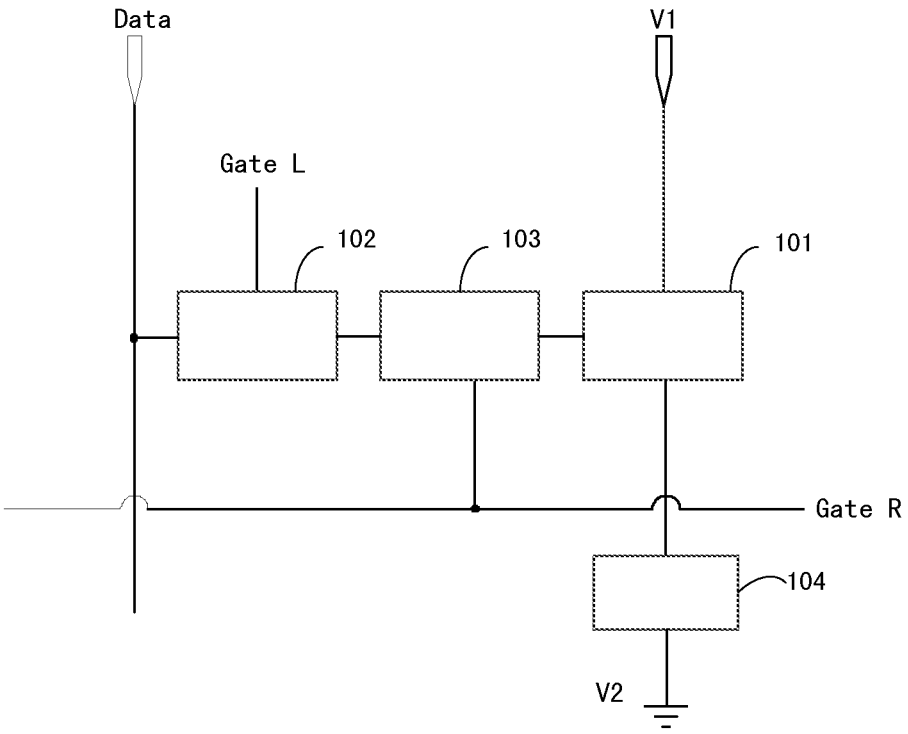
FIG. 1A shows a schematic structural diagram illustrating a pixel unit according to an embodiment of the present disclosure.

As shown in FIG. 1A, the embodiment of the present disclosure may provide a pixel unit, comprising a driving sub-circuit 101, a first switching sub-circuit 102, a second switching sub-circuit 103, and a light-emitting element 104. The driving sub-circuit 101 has a first terminal electrically coupled to a first power supply terminal V1, and a second terminal electrically coupled to a first terminal of the light-emitting element 104. The first switching sub-circuit 102 has an inputting terminal electrically coupled to a data line Data, an outputting terminal electrically coupled to an inputting terminal of the second switching sub-circuit 103, and a controlling terminal electrically coupled to one of a scanning line Gate L and a switch controlling line Gate R. A controlling terminal of the second switching sub-circuit 103 is electrically coupled to the other one of the scanning line Gate L and the switch controlling line Gate R. The second switching sub-circuit 103 has an outputting terminal electrically coupled to an inputting terminal of the driving sub-circuit 101. The first switching sub-circuit 102 and the second switching sub-circuit 103 are configured to selectively input a data voltage signal on the data line Data to a controlling terminal of the driving sub-circuit 101 under the control of a scanning signal on the scanning line Gate L and a switch controlling signal on the switch controlling line Gate R. That is, although the drawing shows that the controlling terminal of the first switching sub-circuit 102 is electrically coupled to the scanning line Gate L and the controlling terminal of the second switching sub-circuit 103 is electrically coupled to the switch controlling line Gate R, positions of the first switching sub-circuit 102 and the second switching sub-circuit 103 are substantially interchanged. In other words, the controlling terminal of the first switching sub-circuit 102 is electrically coupled to the switch controlling line Gate R and the controlling terminal of the second switching sub-circuit 103 is electrically coupled to the scanning line Gate L.

According to an embodiment of the present disclosure, the light-emitting element 104 may be a current driven organic light-emitting diode OLED, and may also be a voltage driven light-emitting element such as a liquid crystal capacitor. The embodiment of the present disclosure is not limited thereto.

Figure 1B:
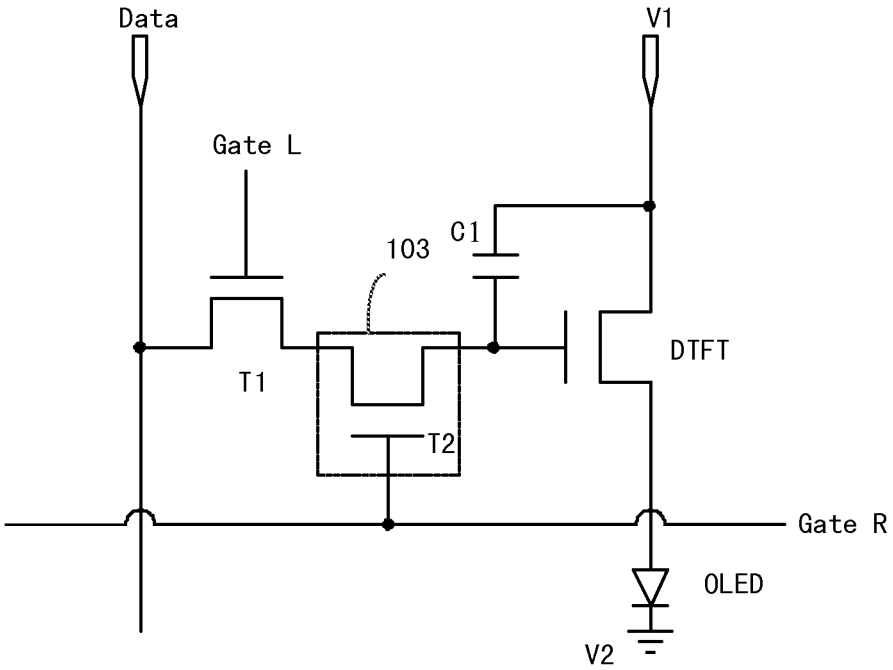
FIG. 1B shows an exemplary circuit diagram illustrating a pixel unit according to an embodiment of the present disclosure.

FIG. 1B shows an exemplary circuit diagram illustrating a pixel unit according to an embodiment of the present disclosure, in which the light-emitting element is an OLED. As shown in FIG. 1B, in the example of FIG. 1B, the controlling terminal of the first switching sub-circuit 102 is electrically coupled to the scanning line Gate L, and the controlling terminal of the second switching sub-circuit 103 is electrically coupled to the switch controlling line Gate R. The second switching sub-circuit 103 is configured to be turned on or off under the control of a switch controlling signal on the switch controlling line Gate R, so as to control whether to write the data voltage signal on the data line Dada to the light-emitting device OLED. For another example, the first switching sub-circuit 102 comprises a switch transistor T1, wherein the switch transistor T1 has a first electrode electrically coupled to the data line Data and a controlling electrode electrically coupled to the scanning line Gate L. As shown in FIG. 1B, the second switching sub-circuit 103 comprises a controlling transistor T2, wherein the controlling transistor T2 has a first electrode electrically coupled to a second electrode of the switch transistor T1, a second electrode electrically coupled to the driving sub-circuit 101 as the outputting terminal of the second switching sub-circuit and a controlling electrode electrically coupled to the switch controlling line Gate R. For another example, the driving sub-circuit 101 comprises: a driving transistor DTFT, wherein the driving transistor DTFT has a first electrode electrically coupled to the first power supply terminal V1 as the inputting terminal of the driving sub-circuit, a second electrode electrically coupled to a first electrode of the light-emitting element 104 as the outputting terminal of the driving sub-circuit, and a controlling electrode electrically coupled to the outputting terminal of the second switching sub-circuit 103 as the controlling terminal of the driving sub-circuit. For example, the first power supply terminal V1 may provide a voltage signal Vdd.

For example, the second terminal of the OLED element can be electrically coupled to a second power supply terminal V2. Those skilled in the art can understand that the second power supply terminal V2 may provide a voltage signal Vss, or may be grounded.

Those skilled in the art can understand that only one basic circuit structure is shown in the example circuit diagram of the pixel unit of the OLED light-emitting element. For example, the circuit may also include, for example, a threshold voltage compensation sub-circuit, a resetting sub-circuit, a light emission controlling sub-circuit, and the like. In this case, it is only necessary to connect the second switching sub-circuit between the second electrode of the switch transistor T1 and an associated circuit component. For example, if the second electrode of the switch transistor T1 in the original pixel unit is coupled to a certain component, according to an embodiment of the present disclosure, the second electrode of the switch transistor T1 is coupled to the first electrode of the controlling transistor T2, and the second electrode of the controlling transistor T2 is coupled to the component.

Since the second switching sub-circuit 103 is provided in the pixel unit in this embodiment, if the pixel unit is applied to a display panel and a scanning is performed on the scanning line Gate L, the second switching sub-circuit 103 is controlled to be turned on or off under the control of the controlling signal input from the switch controlling line Gate R, thereby controlling whether to write the data voltage signal on the corresponding data line Data to a light-emitting element such as an organic electroluminescent diode OLED or a liquid crystal capacitor. That is, by controlling the writing of the data voltage signal to a specific pixel unit in the display panel via the second switching sub-circuit 103, a smart displaying can be realized according to displaying requirements of the display panel.

In an example, when both of the scanning line Gate L and the switch controlling line Gate R are written with the high level signal, both the switch transistor T1 and the controlling transistor T2 are turned on. At this time, the data voltage signal written on the data line Data charges the storage capacitor C1, until the driving transistor DTFT is turned on, thereby driving the organic electroluminescent diode OLED to emit light.

Figure 1C:
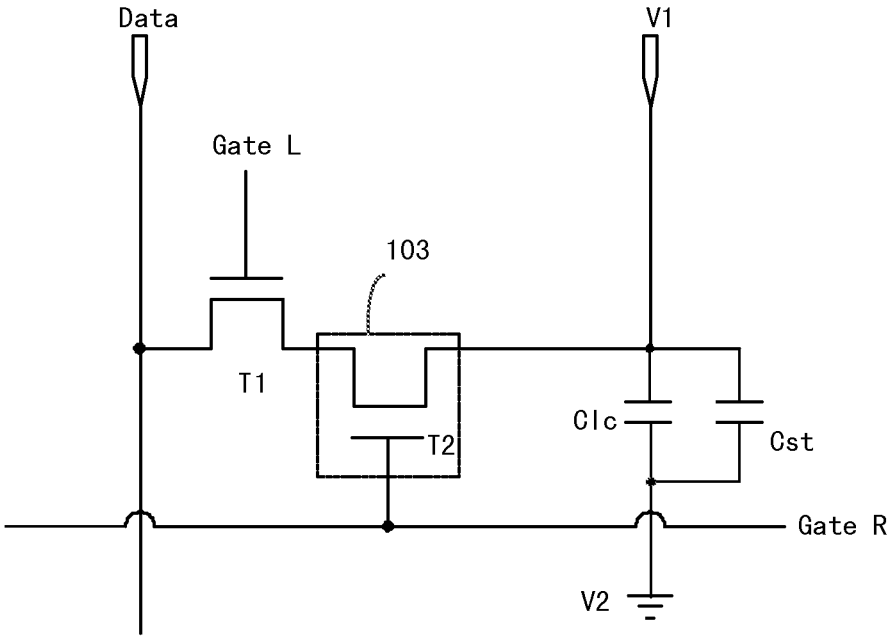
FIG. 1C shows another exemplary circuit diagram illustrating a pixel unit according to an embodiment of the present disclosure.

FIG. 1C shows another exemplary circuit diagram illustrating a pixel unit according to an embodiment of the present disclosure, in which the light-emitting element is a pixel capacitor Clc such as a liquid crystal capacitor. In the example of FIG. 1C, the controlling terminal of the first switching sub-circuit 102 is electrically coupled to the scanning line Gate L, and the controlling terminal of the second switching sub-circuit 103 is electrically coupled to the switch controlling line Gate R. As shown in FIG. 1C, the second switching sub-circuit 103 is configured to be turned on or off under the control of a switch controlling signal on the switch controlling line Gate R, so as to control writing of the data voltage signal on the data line Dada to the pixel capacitor Clc. Similarly, the first switching sub-circuit may include a switch transistor T1, wherein the switch transistor T1 has a first electrode electrically coupled to the data line Dada and a controlling electrode electrically coupled to the scanning line Gate L. As shown in FIG. 1C, the second switching sub-circuit 103 may include a controlling transistor T2, wherein the controlling transistor T2 has a first electrode electrically coupled to the second electrode of the switch transistor T1, a second electrode electrically coupled to the driving sub-circuit, and a controlling electrode electrically coupled to the switch controlling line Gate R. The driving sub-circuit 101 may further comprise a storage capacitor Cst connected with the pixel capacitor Clc in parallel.

Similarly, the pixel capacitor Clc may have a first electrode coupled to the first power supply terminal V1, and a second electrode coupled to the second power supply terminal V2. Those skilled in the art can understand that the second power supply terminal V2 may be a common voltage terminal or may be grounded.

Those skilled in the art can understand that only one basic circuit structure is shown in the example circuit diagram of the pixel unit of the liquid crystal capacitive light-emitting element. For example, the circuit may also include, for example, a common voltage compensation sub-circuit, a resetting sub-circuit, a light emission controlling sub-circuit, and the like. In this case, it is only necessary to connect the second switching sub-circuit between the second electrode of the switch transistor T1 and an associated circuit component. For example, if the second electrode of the switch transistor T1 in the original pixel unit is coupled to a certain component, according to an embodiment of the present disclosure, the second electrode of the switch transistor T1 is coupled to the first electrode of the controlling transistor T2, and the second electrode of the controlling transistor T2 is coupled to the component.

Since the second switching sub-circuit 103 is provided in the pixel unit in this embodiment, if the pixel unit is applied to a display panel and a progressive scanning is performed on the scanning line Gate L, the second switching sub-circuit 103 is controlled to be turned on or off under the control of the controlling signal input from the switch controlling line Gate R, thereby controlling whether to write the data voltage signal on the corresponding data line Data to a light-emitting element such as a pixel capacitor Clc. That is, by controlling the writing of the data voltage signal to a specific pixel unit in the display panel via the second switching sub-circuit 103, a smart displaying can be realized according to displaying requirements of the display panel.

In an example, when both of the scanning line Gate L and the switch controlling line Gate R are written with the high level signal, both the switch transistor T1 and the controlling transistor T2 are turned on. At this time, the data voltage signal written on the data line Data charges the storage capacitor C1, thereby driving the light-emitting element to emit light.

The pixel unit in this embodiment is suitable for a silicon-based display. The pixel cell may be provided on a silicon-based substrate.

Figure 2:
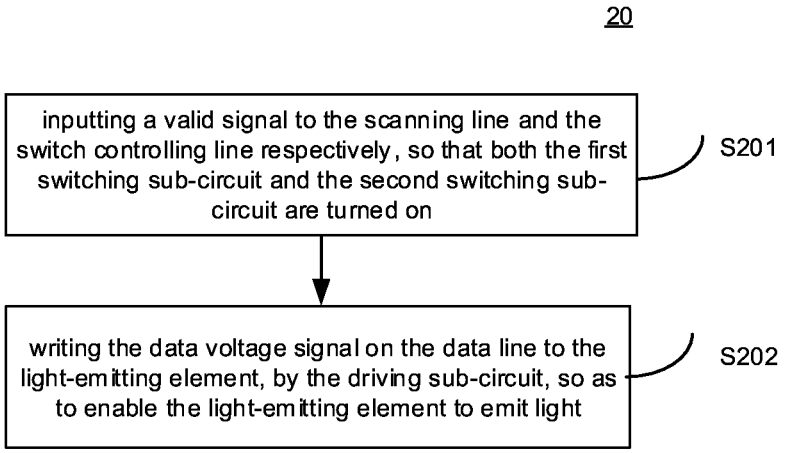
FIG. 2 shows a flowchart of a method for driving a pixel unit according to an embodiment of the present disclosure.

An embodiment of the present disclosure also provides a method for driving the pixel unit discussed above. FIG. 2 shows a flowchart of a method for driving a pixel unit according to an embodiment of the present disclosure. As shown in FIG. 2, the method 20 for driving the pixel unit according to the embodiment of the present disclosure may include the following steps.

In step S201, a valid signal is inputted to the scanning line and the switch controlling line respectively, so that both the first switching sub-circuit and the second switching sub-circuit are turned on.

In step S202, the data voltage signal on the data line is written to the light-emitting element by the driving sub-circuit, so as to enable the light-emitting element to emit light.

Those skilled in the art can understand that when the pixel unit according to the embodiment of the present disclosure is applied to the display panel, each pixel unit needs to maintain the displaying during the display time of one frame, until the arrival of the scanning signal for the next frame. During the period in which the pixel unit maintains the displaying, the scanning signal inputted to the scanning line Gate L which is coupled to the pixel unit is a low-level signal.

An embodiment of the present disclosure may provide a display panel comprising at least one pixel unit of above embodiments.

According to an embodiment of the present disclosure, a second switching sub-circuit is provided in the pixel unit. Therefore, when the scanning line Gate L is progressively scanned, the second switching sub-circuit can be controlled to be turned on or off under the control of the controlling signal from the switch controlling line Gate R, thereby controlling the writing of the data voltage signal on the data line Data to the light-emitting element. Therefore, the writing of the data voltage signal on the data line Data to a specific pixel unit in the display panel is controlled by the second switching sub-circuit, thereby achieving a smart displaying according to the displaying requirements of the display panel.

Figure 3:
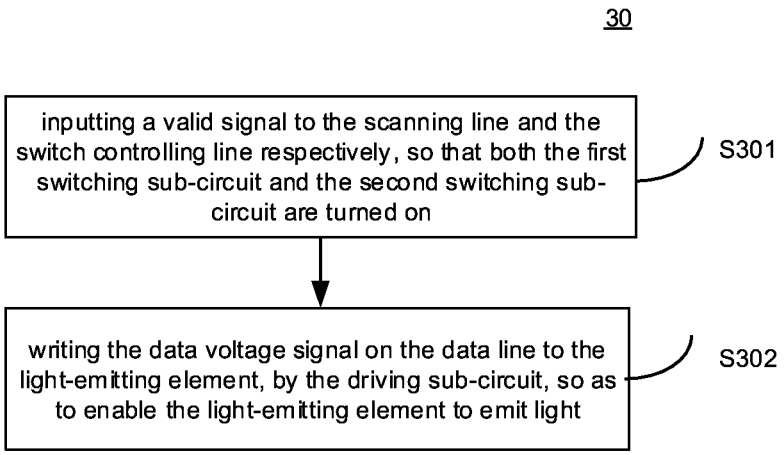
FIG. 3 shows a flowchart of a method for driving a display panel according to an embodiment of the present disclosure.

An embodiment of the present disclosure also provides a method for driving a display panel. FIG. 3 shows a flowchart illustrating a method for driving the display panel according to an embodiment of the present disclosure. As shown in FIG. 3, the method 30 for driving a display panel according to an embodiment of the present disclosure may include the following steps.

In step S301, a valid signal is input to the scanning line and the switch controlling line respectively, so that both the first switching sub-circuit and the second switching sub-circuit are turned on.

In step S302, the data voltage signal on the data line is written to the light-emitting element by the driving sub-circuit, enabling the light-emitting element to emit light.

According to an embodiment of the present disclosure, there is provided a display panel. The display panel is divided into a plurality of display areas arranged in an array, wherein the pixel unit according to above embodiment of the present disclosure is provided in each of the plurality of display areas. The second switching sub-circuits of the plurality of pixel units which are disposed in the same display area are electrically coupled to the same switch controlling line Gate R. That is, the pixel units in the same display area are controlled by the same switch controlling line Gate R. In addition, the second switching sub-circuits of the plurality of pixel units which are disposed in the same column in the display panel are electrically coupled to the same switch controlling line.

When the scanning line Gate L on the display panel is progressively scanned and the switch controlling line Gate R is written with a valid signal, the data voltage signal can be written to the pixel unit in the corresponding display area via the data line Data. Therefore, data voltages can be selectively written into the pixel units in at least part of the display areas in the display panel. Thus, the number of times that the pixel units in the respective display areas are written with the data voltage during the displaying time of one frame can be controlled, thereby realizing different display areas with different refreshing rates. Those skilled in the art can understand that the higher the number of times that the specific display area is written with the data voltage, the higher the refreshing rate.

Figure 4A:
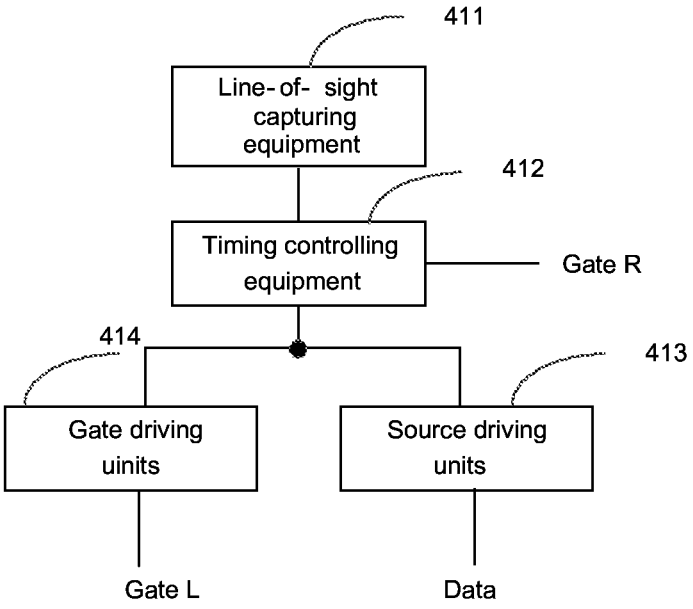
FIG. 4A shows a schematic block diagram illustrating a display panel according to an embodiment of the present disclosure.

FIG. 4A shows a schematic block diagram illustrating a display panel according to an embodiment of the present disclosure. As shown in FIG. 4A, the display panel may further comprise a line-of-sight capturer 411, a timing controller 412, a plurality of source driving units 413 and a plurality of gate driving units 414. The scanning lines Gate L coupled to the pixel units of the same row in the display area are coupled to the same gate driving unit; and the data lines Data coupled to the pixel units of the same column in the display area are coupled to the same source driving unit. The plurality of source driving units 413 and the plurality of gate driving units 414 are coupled to the timing controller 412. Those skilled in the art will understand that the plurality of source driving units 413 are driven by a source driving chip, the plurality of gate driving units 414 are driven by a gate driving chip and the timing controller 412 is driven by a timing controller.

The line-of-sight capturer 411 is configured to capture and track a line-of-sight of a human eye, and to obtain a position of the display area which the line-of-sight of the human eye falls into. The display area which the line-of-sight of the human eye captured by the line-of-sight capturer 411 falls into is set as a first display area. The display areas other than the first display area are set as the second display area.

Figure 4B:
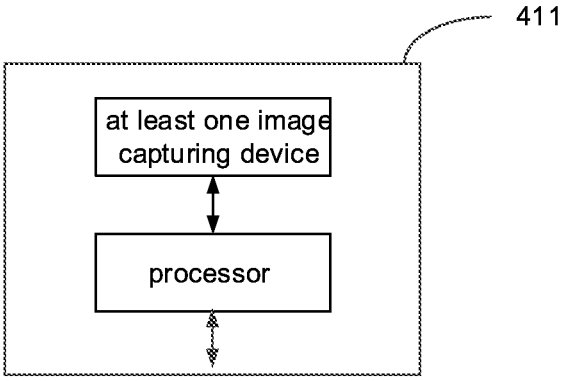
FIG. 4B shows a schematic block diagram illustrating a line-of-sight capturer shown in FIG. 4A.

FIG. 4B shows a schematic block diagram illustrating the line-of-sight capturer 411 according to the embodiment of the present disclosure. As shown in FIG. 4B, the line-of-sight capturer 411 may comprise at least one image capturing device, such as a pupil camera or the like, for capturing the user's eye image. For example, data about the user's single eye or binoculus may be collected, including but not limited to visible light, infrared light, and other video data in the eye region. Then, the collected data may be transmitted to a processor. The processor calculates a direction of the line-of-sight and a position coordinates of the gaze point according to the received data, and outputs the calculated result to the timing controller. Those skilled in the art can understand that the line-of-sight capturer shown in FIG. 4B is only an example, and the line-of-sight capturer according to the embodiment of the present disclosure may be implemented by various conventional line-of-sight capturing technologies or line-of-sight tracking technologies.

The gate driving unit 414 is configured to progressively scan the scanning lines connected thereto with a preset scanning frequency. The source driving unit 413 is configured to provide a data voltage signal to the data lines connected thereto.

The timing controller 412 is configured to control the gate driving unit 414 and the source driving unit 413 so that during the displaying time of one frame, the number of times that the gate driving chip disposed in a line corresponding to the first displaying area outputs the scanning signal is greater than the number of times that the gate driving chip disposed in a line corresponding to the second displaying area outputs the scanning signal; and the number of times that the source driving chip disposed in a column corresponding to the first displaying area outputs the data voltage signal is greater than the number of times that the source driving chip disposed in a column corresponding to the second displaying area outputs the data voltage signal. Since the timing controller 412 enables that the number of times that pixel units in the first displaying area are written with the data voltage is greater than the number of times that pixel units in the second displaying area are written with the data voltage, the refreshing frequency of the first area is greater than the refreshing frequency of the second display area.

Next, the structure of the display panel in this embodiment will be described in conjunction with the following method of driving the display panel. The exemplary description is made by taking the refreshing frequency of the first display area being 120 Hz and the refreshing frequency of the second display area being 60 Hz as an example. In this case, the refreshing frequency of the first display area is twice than the refreshing frequency of the second display area.

Figure 5:
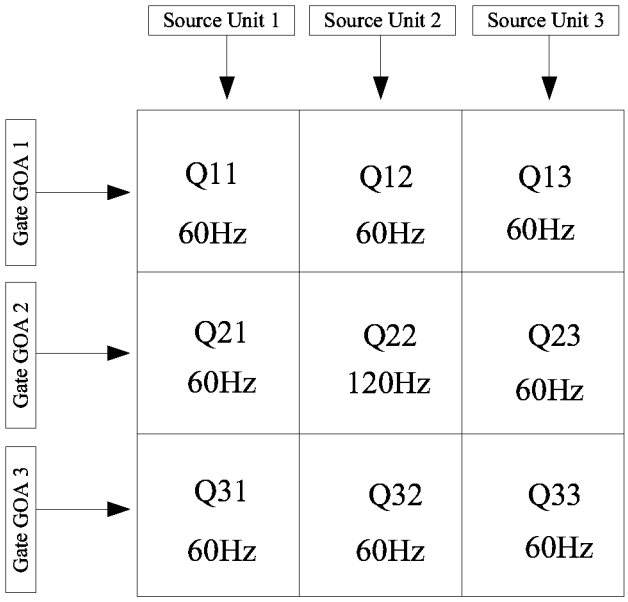
FIG. 5 shows a schematic structural diagram illustrating a display panel according to an embodiment of the present disclosure.

Taking the structure of the display panel shown in FIG. 5 as an example, the display panel is divided into nine display areas Q11, Q12, Q13, Q21, Q22, Q23, Q31, Q32, and Q33. The gate driving unit configured to provide a scanning signal for the scanning lines of the display areas in the first row (Q11, Q12, Q13) is Gate GOA1; the gate driving unit configured to provide a scanning signal for the scanning lines of the display areas in the second row (Q21, Q22, Q23) is Gate GOA2; and the gate driving unit configured to provide a scanning signal for the scanning lines of the display areas in the third row (Q31, Q32, Q33) is Gate GOA3. The source driving unit configured to provide a data voltage signal for the data lines of the display areas in the first row (Q11, Q12, Q13) is Source Unit1; the source driving unit configured to provide a data voltage signal for the data lines of the display areas in the second row (Q21, Q22, Q23) is Source Unit2, and the source driving unit configured to provide a data voltage signal for the data lines of the display areas in the third row (Q31, Q32, Q33) is Source Unit3. The switch controlling lines corresponding to the display areas Q11, Q12, Q13, Q21, Q22, Q23, Q31, Q32, and Q33 are Gate R11, Gate R12, Gate R13, Gate R21, Gate R22, Gate R23, Gate R31, Gate R32, and Gate R33 respectively.

The method for driving the display panel according to the embodiment of the present disclosure may further comprise following steps.

Firstly, the line-of-sight of the human eye is captured by the line-of-sight capturer 411. Then, a position of the display area which the line-of-sight of the human eye falls into is obtained. The position of the display area which the line-of-sight of the human eye falls into is set as the first display area, and the display areas other than the first display area is set as the second display area.

For example, if the line-of-sight captured by the line-of-sight capturer falls exactly in the display area Q22, the display area Q22 is the first display area, and the other eight display areas are the second display area.

Subsequently, a valid signal (a high level signal) is input to all of the switch controlling lines (Gate R11, Gate R12, Gate R13, Gate R21, Gate R22, Gate R23, Gate R31, Gate R32 and Gate R33) sequentially through the timing controller, so as to control the Gate GOA1, the Gate GOA2 and the Gate GOA3 to work one by one.

Taking the scanning of the pixel units of the display areas in first row via the Gate GOA1 as an example, the Gate GOA1 progressively scans the scanning lines corresponding to the display areas in the first row at a preset scanning frequency (60 Hz). At the same time, the timing controllers, Source Unit 1, Source Unit 2, and Source Unit 3, output data voltage signals and writes the data voltage signals into the corresponding pixel units for displaying. The process of each pixel unit being driven is as described above and will not be described in detail herein.

Similarly, after all scanning lines of the display areas in the first row are scanned, Gate GOA2 and Gate GOA3 will scan the display areas in the second row and the display areas in the third row respectively in the same manner.

After that, since the first display area captured by the line-of-sight capturer is Q22, and the gate driving unit and the source driving unit for driving each pixel unit in Q22 are Gate GOA2 and Source Unit 2 respectively, the switch controller only controls Gate R22 to input a high level signal. That is, only the pixel units in the display area Q22 are controlled to operate. At the same time, the timing controller controls the Gate GOA2 to scan the scanning lines corresponding to the display area in second row at a preset scanning frequency (60 Hz), and controls the Source Unit 2 to output the data voltage signal to each pixel unit in Q22. At this time, the refreshing frequency in the display area Q22 is 120 Hz.

It can be seen that each pixel unit in the display area Q22 is scanned twice during the displaying time of one frame, and the data voltage is also written twice for the pixel unit in the display area Q22, but the other display areas are scanned once. Therefore, the refreshing frequency of the display area where the line-of-sight falls into is twice than that of other display areas.

In the above scanning process, during the displaying time of one frame, the scanning sequence for the display areas in the second column is is Q12→Q22→Q32→Q22, so as to achieve an effect that the refreshing frequency of the display area Q22 is twice than other display areas. Similarly, if it is determined that the display area where the line-of-sight is positioned is Q12, the scanning sequence for the display areas in the second column is Q12→Q22→Q32→Q12. If it is determined that the display area where the line-of-sight is positioned is Q32, the scanning sequence for the display areas in the second column is Q12→(32→Q22→Q32.

According to the display panel and the driving method thereof in the embodiments of the present disclosure, the line-of-sight capturer determines the display area which the line-of-sight falls into, and displays pictures at different display areas with different refreshing frequencies according to display requirements. Therefore, the power consumption for displaying can be effectively reduced, so that the screen can be switched selectively to have a high refreshing frequency or a low refreshing frequency, achieving an adjustable refreshing frequency.

Figure 6:
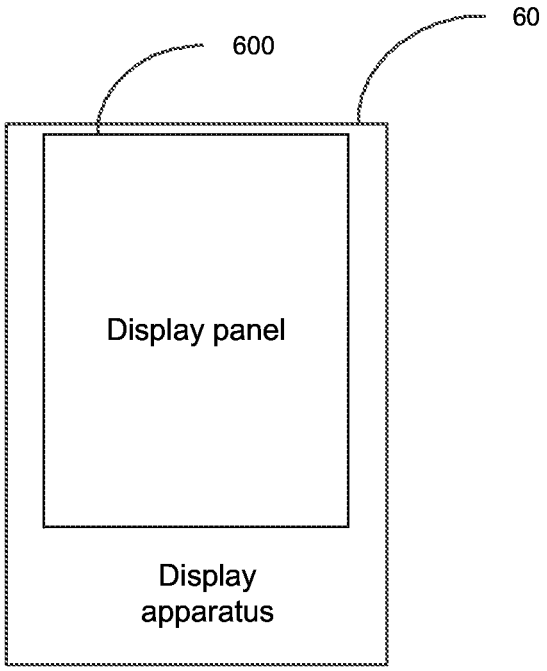
FIG. 6 shows a schematic block diagram illustrating a display apparatus according to an embodiment of the present disclosure.

The present embodiment further provides a display device including a display apparatus according to any of above embodiments of the present disclosure. FIG. 6 shows a schematic block diagram illustrating a display apparatus according to an embodiment of the present disclosure. As shown in FIG. 6, the display apparatus 60 may comprise a display panel 600 according to an embodiment of the present disclosure. The display apparatus according to the embodiment of the present disclosure may implement displaying in different display regions with different refreshing frequencies. The display apparatus may be any product or component having a display function such as a mobile phone, a tablet computer, a television, a monitor, a notebook computer, a digital photo frame, a navigator, and the like.

Certainly, the display apparatus according to the embodiment may also comprise other conventional structures, such as a power supply unit, a display driving unit, and the like.

It should be understood that the above embodiments are merely exemplary embodiments employed for illustrating the principle of the present disclosure, but the present disclosure is not limited thereto. For those skilled in the art, various variations and improvements may be made without departing from the spirit and essence of the present disclosure, and these variations and improvements are also considered to fall within the scope of the present disclosure.

We claim:

1. A pixel unit comprising a driving sub-circuit, a first switching sub-circuit, a second switching sub-circuit, and a light-emitting element, comprising:

the driving sub-circuit having a first terminal electrically coupled to a first power supply terminal, and a second terminal electrically coupled to a first terminal of the light-emitting element;

the first switching sub-circuit having an inputting terminal electrically coupled to a data line, and an outputting terminal electrically coupled to an inputting terminal of the second switching sub-circuit; and the second switching sub-circuit having an outputting terminal electrically coupled to an inputting terminal of the driving sub-circuit;

wherein the controlling terminal of the first switching sub-circuit is electrically coupled to one of a scanning line and a switch controlling line, and a controlling terminal of the second switching sub-circuit is electrically coupled to the other one of the scanning line and the switch controlling line; and wherein the first switching sub-circuit and the second switching sub-circuit are configured to selectively input a data voltage signal on the data line to a controlling terminal of the driving sub-circuit under a control of a scanning signal on the scanning line and a control of a switch controlling signal on the switch controlling line, so as to control a lighting of the light-emitting element.

2. The pixel unit of claim 1, wherein the first switching sub-circuit is electrically coupled to the scanning line, and the second switching sub-circuit is electrically coupled to the switch controlling line, and the second switching sub-circuit is configured to be turned on or off under the control of a switch controlling signal on the switch controlling line, so as to control writing of the data voltage signal on the data line into the light-emitting element.

3. The pixel unit of claim 2, wherein the first switching sub-circuit comprises a switch transistor;

wherein the switch transistor has a first electrode electrically coupled to the data line and a controlling electrode electrically coupled to the scanning line;

wherein the second switching sub-circuit comprises a controlling transistor; and wherein the controlling transistor has a first electrode electrically coupled to a second electrode of the switch transistor, a second electrode electrically coupled to the driving sub-circuit, and a controlling electrode electrically coupled to the switch controlling line.

4. The pixel unit of claim 1, wherein the driving sub-circuit comprises:

a driving transistor, wherein the driving transistor has a first electrode electrically coupled to the first power supply terminal, a second electrode electrically coupled to a first electrode of the light-emitting element, and a controlling electrode electrically coupled to the outputting terminal of the second switching sub-circuit; and a storage capacitor, wherein the storage capacitor has a first electrode electrically coupled to the first power supply terminal and a second electrode electrically coupled to a controlling electrode of the driving transistor.

5. The pixel unit of claim 1, wherein the pixel unit is provided on a silicon-based substrate.

6. A method for driving the pixel unit of claim 1, comprising:

inputting a valid signal to the scanning line and the switch controlling line respectively, so that both the first switching sub-circuit and the second switching sub-circuit are turned on; and writing the data voltage signal on the data line to the light-emitting element, by the driving sub-circuit, so as to enable the light-emitting element to emit light.

7. A display panel comprising at least one pixel unit of claim 1.

8. The display panel of claim 7, wherein the display panel is divided into a plurality of display areas arranged in an array; and wherein the second switching sub-circuits of the plurality of pixel units which are disposed in the same display area are electrically coupled to the same switch controlling line.

9. The display panel of claim 8, further comprises a line-of-sight capturer and a timing controller, wherein the line-of-sight capturer is configured to capture and track a line-of-sight of a human eye, and to obtain a position of the display area which the line-of-sight of the human eye falls into; wherein the position of the display area which the line-of-sight of the human eye falls into is set as the first display area, and the display areas other than the first display area is set as the second display area; and wherein the timing controller is configured, such that the number of times that the pixel units in the first display area are written with the data voltage signal is greater than the number of times the pixel units in the second display area are written with the data voltage signal, during a displaying time of a frame.

10. The display panel of claim 9, further comprises a plurality of gate driving units and a plurality of source driving units coupled to the timing controller, wherein the scanning lines coupled to the pixel units of the same row in the display area are coupled to the same gate driving unit; and wherein the data lines coupled to the pixel units of the same column in the display area are coupled to the same source driving unit.

11. The display panel of claim 7, wherein the second switching sub-circuits of the plurality of pixel units which are disposed in the same column in the display panel are electrically coupled to the same switch controlling line.

12. The display panel of claim 9, wherein a refreshing frequency of the first display area is 2 times than that of the second display area.

13. A method for driving the display panel of claim 7, comprising:

inputting a valid signal to the scanning line and the switch controlling line respectively, so that both the first switching sub-circuit and the second switching sub-circuit are turned on; and writing the data voltage signal on the data line to the light-emitting element, by the driving sub-circuit, so as to enable the light-emitting element to emit light.

14. The method of claim 13, wherein the display panel further comprises a line-of-sight capturer and a timing controller, and the method comprising:

capturing and tracking a line-of-sight of a human eye by the line-of-sight capturer, and obtaining a position of the display area which the line-of-sight of the human eye falls into, prior to inputting the valid signal to the scanning line and the switch controlling line; wherein the position of the display area which the line-of-sight of the human eye falls into is set as the first display area, and the display areas other than the first display area is set as the second display area.

15. The method of claim 14, wherein the method further comprises configuring the timing controller, such that during a displaying time of a frame, the number of times that the scanning lines and the switch controlling lines coupled to the pixel units in the first display area are inputted with the valid signal is greater than the number of times that the scanning lines and the switch controlling lines coupled to the pixel units in the second display area are inputted with the valid signal; and the number of times that the data lines coupled to the pixel units in the first display area are written with the data voltage signal is greater than the number of times that the data lines coupled to the pixel units in the second display area are written with the data voltage signal, under the control of the configured timing controller.

16. The display panel of claim 7, wherein the display panel is included in a display device.

17. The pixel unit of claim 2, wherein the first switching sub-circuit comprises a switch transistor, wherein the switch transistor has a first electrode electrically coupled to the data line and a controlling electrode electrically coupled to the scanning line; and wherein the second switching sub-circuit comprises a controlling transistor, wherein the controlling transistor has a first electrode electrically coupled to a second electrode of the switch transistor, a second electrode electrically coupled to the driving sub-circuit and a controlling electrode electrically coupled to the switch controlling line.

* * * * *